US005580294A

United States Patent [19]

Briant

[11] Patent Number: 5,580,294

[45] Date of Patent: Dec. 3, 1996

[54] TOY CASTLE

[76] Inventor: William E. Briant, 6418 N. Magnolia, Chicago, Ill. 60626

[21] Appl. No.: 449,897

[22] Filed: May 23, 1995

[51] Int. Cl.[6] ..... A63H 33/08; A63H 3/52

[52] U.S. Cl. ..... 446/110; 446/476

[58] Field of Search ..... 446/110, 113, 446/114, 125, 476, 115

[56] References Cited

U.S. PATENT DOCUMENTS

| | | | |
|---|---|---|---|
| D. 169,888 | 6/1953 | Beyer | 446/476 X |
| 1,061,637 | 5/1913 | Schwarz | 446/476 X |
| 1,883,214 | 10/1932 | Wilson et al. | 446/113 X |
| 4,419,840 | 12/1983 | Pope | 446/110 |
| 4,569,664 | 2/1986 | Giampetruzzi et al. | 446/110 |

FOREIGN PATENT DOCUMENTS

| | | | |
|---|---|---|---|
| 125547 | 4/1919 | United Kingdom | 446/110 |

*Primary Examiner*—Mickey Yu

*Attorney, Agent, or Firm*—Dorn, McEachran, Jambor & Keating

[57] ABSTRACT

A toy castle formed from a plurality of assembly pieces includes a front wall, two side walls and a rear wall. Four corner towers connecting the castle walls. A gate tower is connected to the front wall and extends away from the interior of the castle. A central keep is connected to the rear wall and extends into the interior of the castle. A plurality of wall walks suspended from the front, side and rear walls extend around the inside perimeter of the castle walls. Each assembly piece is formed with interlocking elongated slots for connection with other assembly pieces, such that no special tools or fasteners are required.

10 Claims, 4 Drawing Sheets

Fig.1.
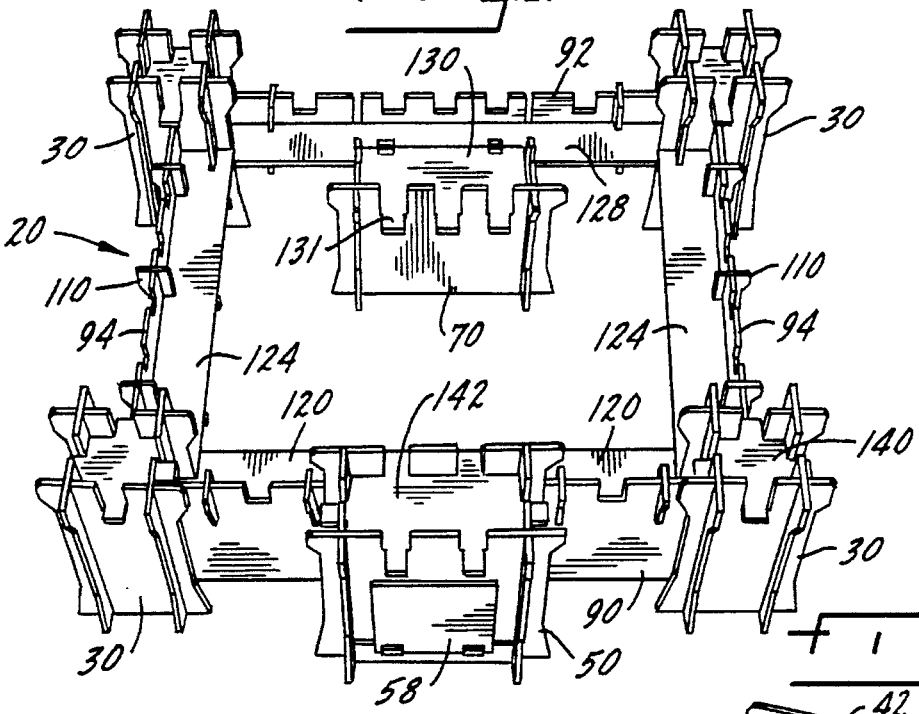
Fig.3.
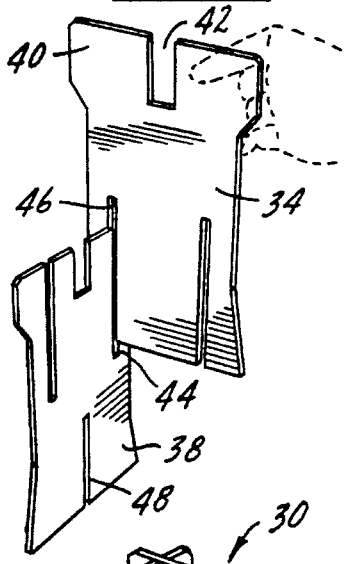
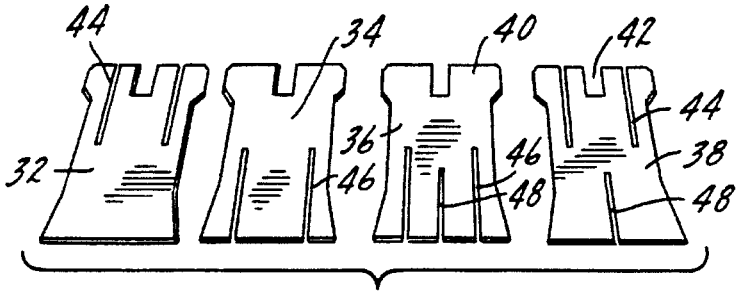
Fig.2.
Fig.4.
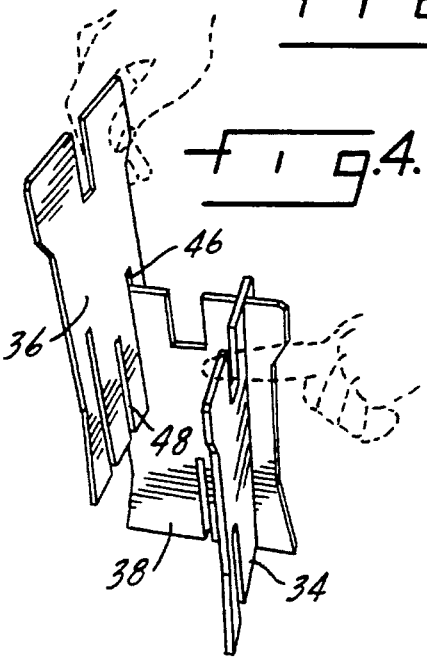
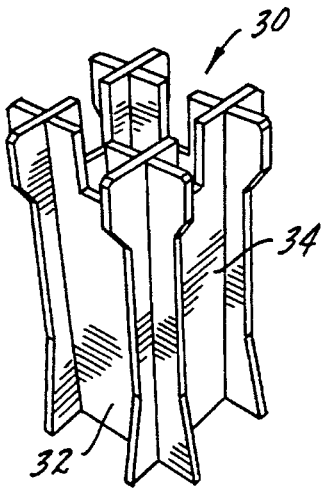
Fig.5.
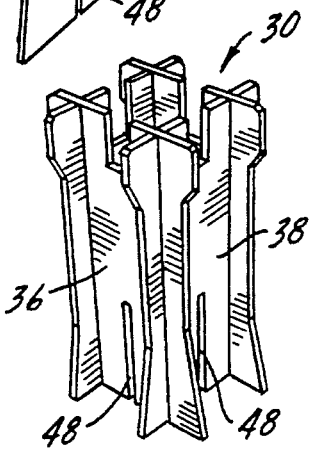
Fig.6.

Fig. 7.
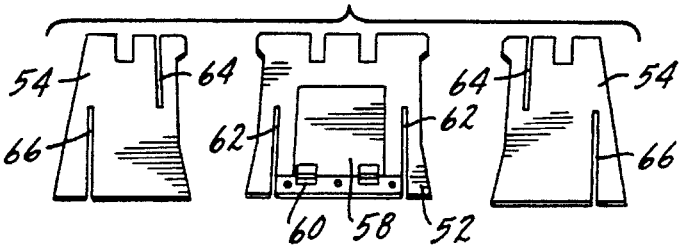
Fig. 8.
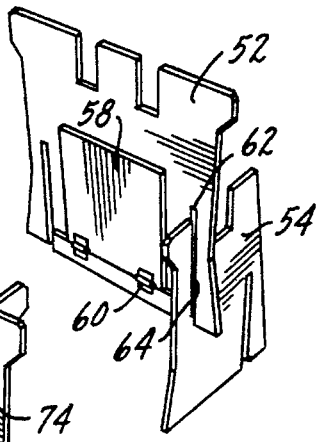
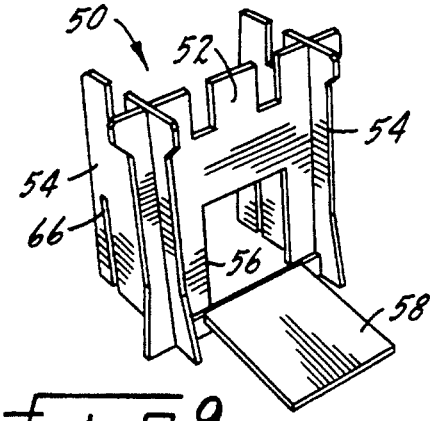
Fig. 9.
Fig. 11.
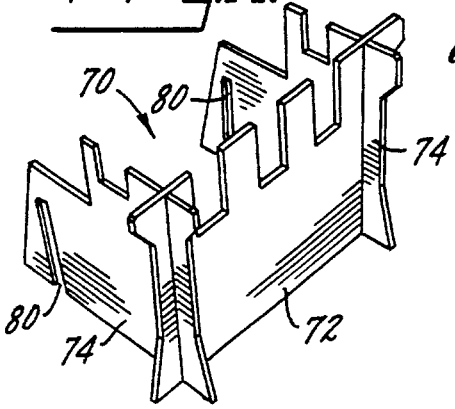
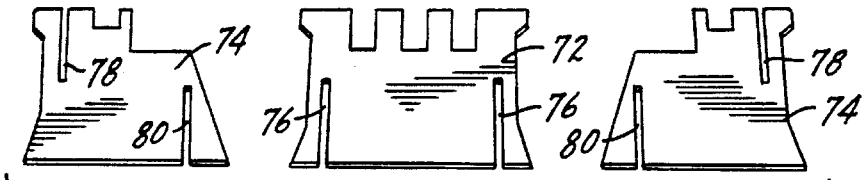
Fig. 10.
Fig. 12.
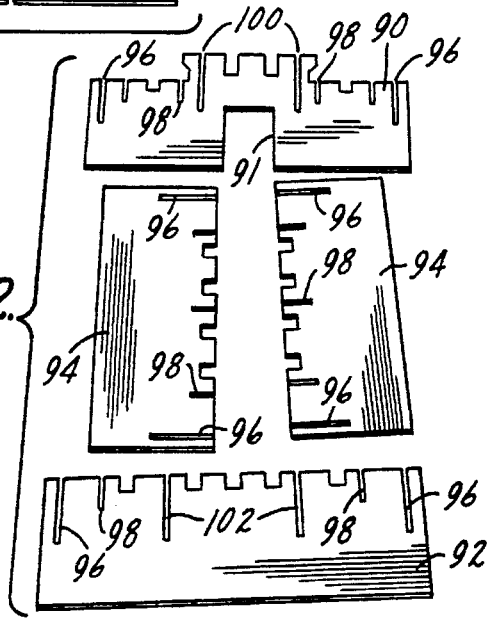

TOY CASTLE

BACKGROUND AND SUMMARY OF THE INVENTION

This invention is directed to a toy castle which can be assembled on a level surface such as a floor or a tabletop. The castle is patterned after a full-scale castle of medieval times and is intended for use primarily by younger children. The castle is of sufficient size to permit smaller children to climb into or around the assembled castle. Alternatively, the children may choose to populate the castle with replicas of medieval characters and implements.

The assembled castle, although relatively large in area, is easily disassembled and can be stored in a storage box or container. Neither assembly nor disassembly requires use of any special tools or fasteners.

Accordingly, one object of this invention is an assemble and disassemble toy castle which simulates an actual medieval castle.

Another object of this invention is a toy castle which may be assembled and disassembled without use of special tools or fasteners.

Still another object of this invention is a toy castle formed from assembly pieces having interlocking slots which extend through approximately half of the length of their associated pieces.

A further object of this invention is a toy castle having a network of suspended wall walks about its inside periphery.

One more object of this invention is a toy castle having a central keep with a roof hinged to one of the wall walks.

Other objects of this invention will become apparent in the ensuing specification, claims and drawings.

BRIEF DESCRIPTION OF THE DRAWINGS

FIG. 1 is a perspective view of an assembled toy castle according to the present invention;

FIG. 2 is a perspective view of four corner tower pieces;

FIG. 3 is a perspective view illustrating connection of two corner tower pieces;

FIG. 4 is a perspective view illustrating connection of three corner tower pieces;

FIG. 5 is a perspective view of a fully assembled corner tower;

FIG. 6 is a perspective view of the corner tower of FIG. 5, rotated one-hundred eighty degrees;

FIG. 7 is a perspective view of three gate tower pieces;

FIG. 8 is a perspective view illustrating connection of two gate tower pieces;

FIG. 9 is a perspective view of a fully assembled gate tower;

FIG. 10 is a perspective view of three central keep pieces;

FIG. 11 is a perspective view of a fully assembled central keep;

FIG. 12 is a perspective view of four castle walls;

DETAILED DESCRIPTION OF THE INVENTION

Figure 13:
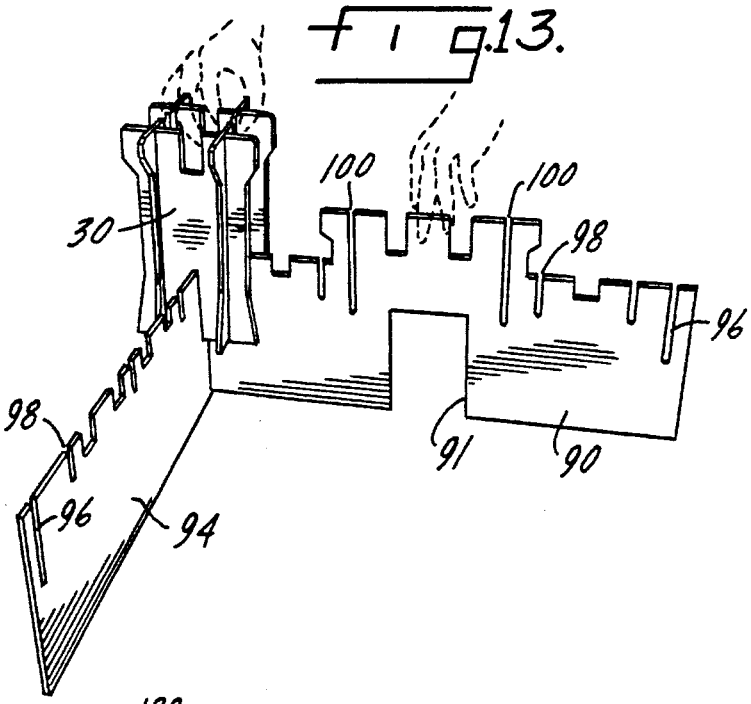
FIG. 13 is a perspective view showing connection of a corner tower to two castle walls.

An assembled toy castle 20 according to the present invention is illustrated in FIG. 1. Castle 20 is a scaled-down replica of a medieval castle. It is assembled from a plurality of slotted, interlocking construction pieces formed out of a lightweight material such as pressboard or plywood. Assembly does not require use of clips, screws or any other type of mechanical fastener.

First, an overview of castle 20 is provided. Castle 20 includes a front wall 90, a rear wall 92 and two sidewalls 94. Four corner towers 30 are connected at the wall intersections. A gate tower 50 having a drawbridge 58 is attached to front wall 90, and a central keep 70 is attached to rear wall 92. Front wall walks 120, side wall walks 124 and rear wall walk 128 are mounted around the inside periphery of the castle walls. The wall walks are supported by wall walk supports 110.

The assembly, construction and unique features of castle 20 will now be described in more detail. It should be understood that though a particular sequence of assembly is described, many other assembly sequences are possible. In fact, part of the appeal of the toy castle to a child may be the challenge of putting it together in a different order or sequence than was used before.

FIG. 2 depicts four assembly pieces 32, 34, 36 and 38 of a corner tower 30. In a fully assembled castle 20, there are four corner towers 30 (FIG. 1). Each tower is assembled from four pieces identical to those shown in FIG. 2. In a preferred embodiment, each corner tower piece is approximately 10.5 inches high and 5.0 inches wide (through the mid-section).

A series of solid merlons 40 and open crenels 42 are formed atop each corner tower piece to define a decorative battlement or parapet. This is also the case with all of the other upstanding construction pieces that form a part of castle 20. Corner tower pieces 32 and 38 are formed with a pair of top slots 44, and pieces 34 and 36 are formed with a pair of bottom slots 46. As shown in FIGS. 3–6, bottom slots 46 of pieces 34 and 36 mate with top slots 44 of pieces 32 and 38 (or vice-versa) to permit assembly of the rectangular or box-like corner tower. Construction does not necessarily have to proceed as shown in FIGS. 3–6. As a rule, however, the two pieces with top slots will be opposite and parallel to each other, and normal and adjoined to the pieces with bottom slots.

Slots 44 and 46 each extend vertically approximately half of the total vertical height of their associated corner tower pieces. In the preferred embodiment, this corresponds to a slot length of 5.25 inches (total height is 10.5 inches). Thus, each slot receives fully half of its adjacent or mating corner tower piece. This feature of slots extending at least halfway through the length of their associated piece is an important part of this invention, and is repeated in most of the assembly pieces. It provides a more sturdy and stable construction than do assembled structures utilizing pieces having interlocking notches which extend a distance significantly less than half of the piece length.

Middle slots 48 extend from the bottoms of pieces 36 and 38 approximately halfway to the bottom edges of crenels 42.

As best seen in FIG. 6, in a fully assembled corner tower 30 the two pieces having middle slots 48 will be adjacent and normal to each other. Middle slots 48 facilitate connection of the assembled corner towers 30 to the castle walls, as will be described herein.

FIG. 7 illustrates the three assembly pieces for gate tower 50: a front gate 52 and two sidewalls 54. Gate 52 and sidewalls 54 are the same height as the corner tower pieces—10.5 inches in the preferred embodiment. Gate 52 has a median width of 9.0 inches, while sidewalls 54 have a median width of 5.5 inches.

Front gate 52 includes a drawbridge 58 attached to gate 52 by hinges 60. As seen in FIG. 9, drawbridge 58 swings open to uncover an entrance 56. Drawbridge 58 is straddled by two slots 62. Slots 62 extend from the bottom edge of gate 52 approximately half of the distance to the top edge. Alternating crenels and merlons formed atop gate 52 define a decorative battlement. Gate 52 and drawbridge 58 may be adorned with decorative symbols, slogans or other insignia.

Sidewalls 54 are formed with a top slot 64 at one end and a bottom slot 66 at the other end. Again, these slots extend through approximately half of the vertical length of the sidewalls. The top edges of sidewalls 54 are formed with battlements. As seen in FIGS. 8–9, gate tower 50 is assembled by positioning sidewalls 54 normal to gate 52 such that top slots 64 of the sidewalls are aligned with bottom slots 62 of the gate. The slots are then interconnected to form gate tower 50. Bottom slots 66 are meant for later connection of the gate tower to the front wall of the castle.

FIG. 10 illustrates the three construction pieces for central keep 70: a center wall 72 and two sidewalls 74. The pieces of keep 70 have a height slightly shorter than that of the previously described pieces and the castle walls—8.0 inches in the preferred embodiment. In the preferred embodiment, center wall 72 has a median width of 10.0 inches and sidewalls 74 have a median width of about 7.5 inches.

Center wall 72 includes two spaced slots 76 extending from the bottom edge approximately half way to the top edge. Sidewalls 74 include mating slots 78 depending from their top edges. The interconnection of the center wall and sidewall slots to form keep 70 is shown in FIG. 11. Slots 80 extending from the bottom edges of sidewalls 74 at the opposite sides of sidewalls 74 will later be connected to mating slots in the rear castle wall. As with the other construction pieces, center wall 72 and sidewalls 74 include alternating crenels and merlons along their top edges to define battlements.

FIG. 12 depicts the front castle wall 90, rear castle wall 92 and castle sidewalls 94. In the preferred embodiment, front wall 92 is 24.0 inches wide and 10.5 inches high at the prominent, center battlement; 8.0 inches high at the lower side battlements which straddle the center battlement. Front wall 90 defines an entrance 91 which is approximately 5.75 inches high and 4.0 inches wide. Rear wall 92 is 24.0 inches wide and 8.0 inches high. Sidewalls 94 are 20.0 inches wide and 8.0 inches high.

Each castle wall includes a pair of corner slots 96 depending from opposite ends of the top edge. Slots 96 extend approximately half the distance to the bottom edges of the castle walls. Each wall also includes a plurality of shorter wall walk support slots 98, the purpose of which will be described shortly. Front wall 90 includes two centrally located gate tower slots 100, and rear wall 92 includes two centrally located keep slots 102.

FIG. 13 illustrates erection of the castle walls utilizing the corner towers. In FIG. 13, front wall 90 is positioned normal and end-to-end relative to a sidewall 94. Then, corner tower 30 is aligned above the castle walls, and the castle walls adjusted as necessary, such that middle slots 48 of corner towers 30 are aligned with the adjacent corner slots 96 formed in front wall 90 and sidewall 92. The corner tower is then pressed down such that the slots interlock. This process is repeated at each corner junction of the castle.

Gate tower 50 and central keep 70 are connected to the front and rear castle walls in a like manner. Slots 66 of gate tower 50 are aligned and mate with gate tower slots 100 formed in front wall 90, such that gate tower 50 is attached to and protrudes in front of front wall 90 and entrance 91. Slots 80 of keep 70 are aligned and mate with keep slots 102 formed in rear wall 92, such that keep 70 is attached to rear wall 72 and protrudes into the interior of castle 20 (see FIGS. 1 and 18).

Figure 14:
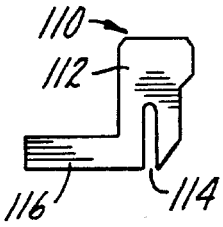
FIG. 14 is a side view of a wall walk support.
Figure 15:
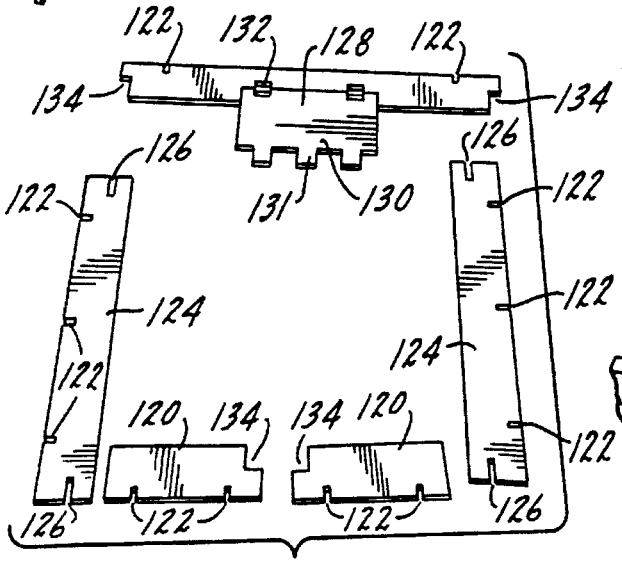
FIG. 15 is a perspective view of four wall walks, including a hinged central keep roof.

FIGS. 14 and 15 illustrate wall walks (FIG. 15) and a wall walk support (FIG. 14). Wall walk support 110 is "L" shaped and includes a vertical hanging portion 112 with a vertical slot 114 formed approximately halfway therethrough, and a horizontal ledge 116 extending from the bottom of hanging portion 112. In the preferred embodiment, hanging portions 112 have a median vertical height of 3.0 inches and width of 1.25 inches, and ledges 116 have a median vertical height of 0.75 inches and width of 2.0 inches. Slots 114 should have the same length as the wall walk support slots 98 formed in the castle walls (approximately 1.5 inches).

The wall walks illustrated in FIG. 15 include two front wall walks 120, two side wall walks 124 and a rear wall walk 128. A central keep roof 130 is attached by hinges 132 to rear walk 128. When walk 128 is installed, roof 130 swings over and covers the top of central keep 70 (see FIGS. 1 and 18). Roof 130 includes projecting tabs 131 which are aligned with and extend through the crenels of the battlement atop central keep 70. The walks are sized to fit within the inside castle periphery defined by the castle walls and corner towers.

Each walk includes a plurality of spaced side slots 122 which are sized to receive and fit around hanging portions 112 of wall walk supports 110. The spacing between slots 122 corresponds to the spacing between slots 98 formed in the castle walls. Side walks 124 each include a pair of end slots 126 which, when assembled, receive projecting edges of an adjacent corner tower. Front walks 120 and rear walk 128 include end cut-out portions 134 which, when assembled, receive a projecting edge of an adjacent corner tower and an end portion of an adjacent side walk.

Figure 16:
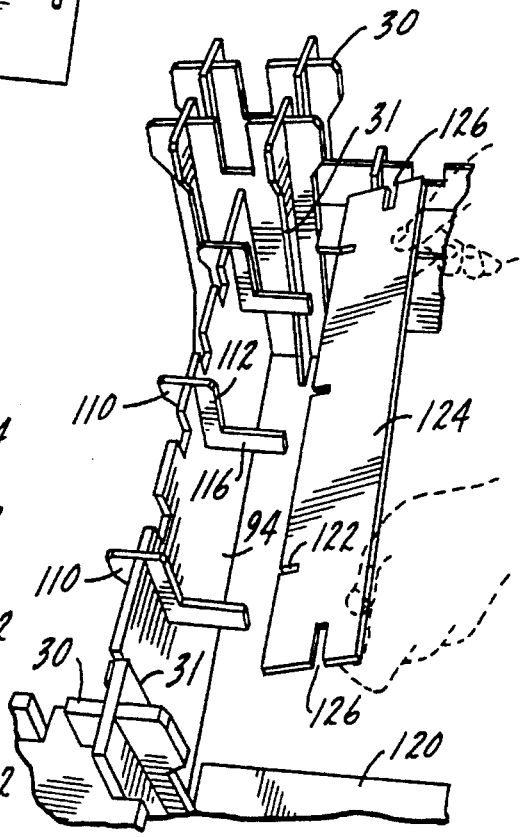
FIG. 16 is a partial perspective view showing assembly of a wall walk and wall walk supports.

FIG. 16 depicts placement of a side wall walk 124 on wall walk supports 110. Prior to placement of walk 124, supports 110 are installed in slots 98 formed about the tops of the castle walls. Slots 114 formed in supports 110 fit into slots 98. As seen in FIG. 16, hanging portions 112 of supports 110 secure supports 110 to the castle wall, and ledges 116 extend away from the walls to provide support for the wall walks. Walk 124 is then placed atop ledges 116, with slots 122 receiving hanging portions 112 and slots 126 receiving projecting edges 31 of corner towers 30. Front walks 120 and rear walk 128 are hung in a like fashion.

Figure 18:
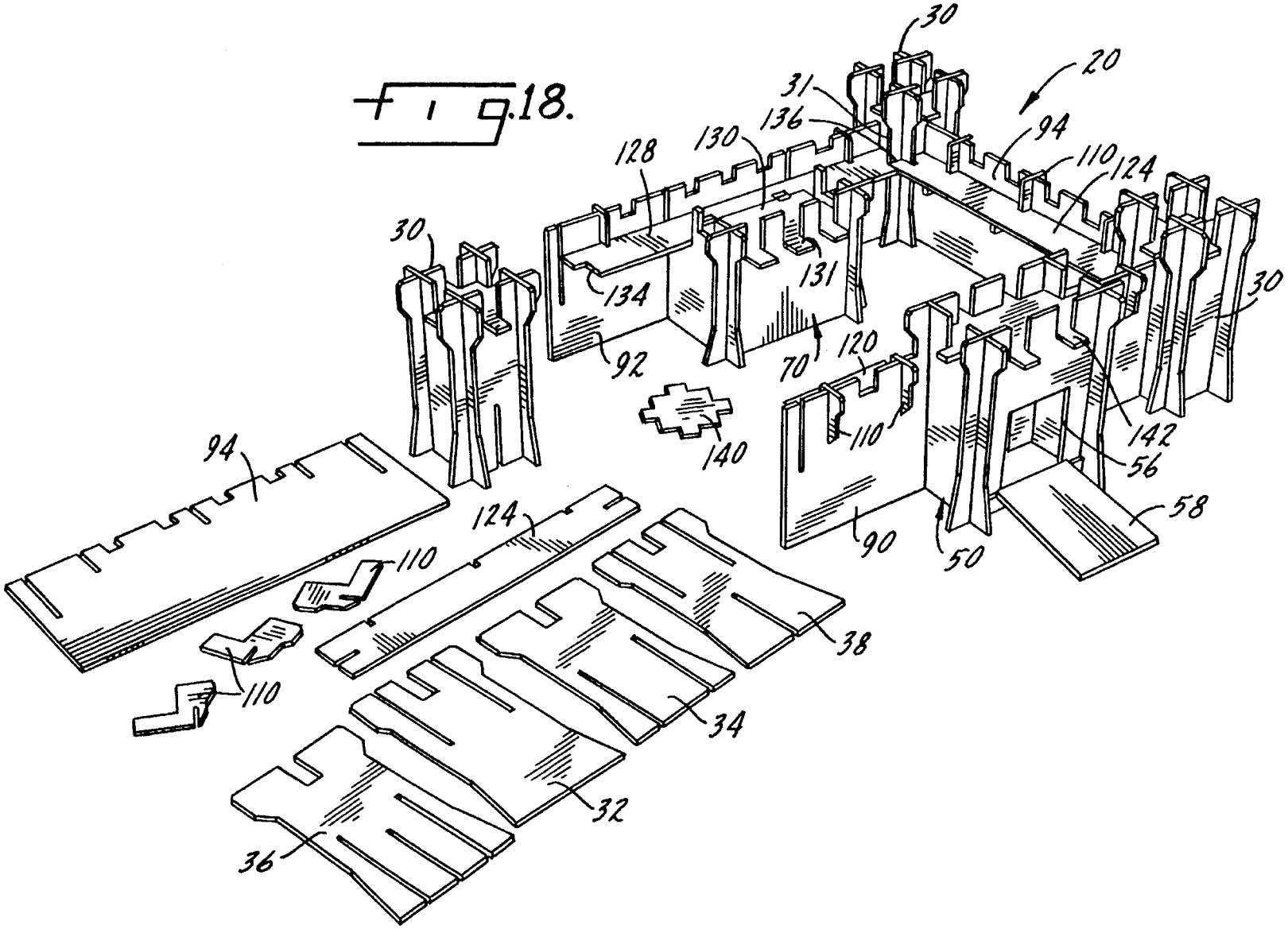
FIG. 18 is a perspective view of a partially disassembled castle.

FIG. 18, which depicts a partially disassembled castle 20, perhaps best shows the relative positioning of adjacent wall walks to define a continuous wall walk. At the location generally designated 136, it can be seen that the end cut-out portion of rear wall walk 128 is sized to receive projecting edge 31 of corner tower 30 as well as a terminal portion of side walk 124, which has an end notch to receive another projecting edge of corner tower 30. The result is a peripherally continuous wall walk inside the castle walls (FIG. 1), with the exception of the area immediately inside of gate tower 50.

Figure 17:
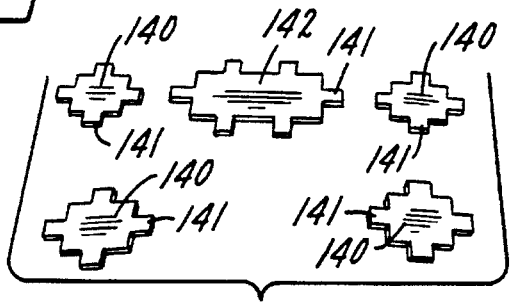
FIG. 17 is a perspective view of four corner tower roofs and a gate tower roof.

The final step in assembly is placement of corner tower roofs 140 and gate tower roof 142, which are illustrated in FIG. 17. Each roof is sized to cover the open top of their respective towers, and each include projecting tab portions 141 which extend through the crenels of the battlements atop the towers to secure the roof in place. Installation is a simple matter of aligning the projecting portions 141 with the crenels.

From the foregoing, it can be seen that castle 20 may be assembled from start to finish without use of any special tools or fasteners. The only fasteners or screws utilized are those in hinges 60 (for drawbridge 58) and hinges 132 (for keep roof 130). These, however, are installed in the manufacturing stage and will not have to be dealt with by an assembling child.

Various features of the present invention have been explained with reference to the embodiment shown and described. It should be understood, however, that modification may be made without departing from the spirit and scope of the invention as represented by the following claims.

I claim:

1. A toy castle formed from a plurality of assembly pieces comprising:

a front wall including an open entrance, two side walls and a rear wall;

four corner towers connecting said walls;

a gate tower connected to said front wall and extending away from an interior portion of said castle, said gate tower including an entrance leading to said front wall entrance and a hinged attached drawbridge which can be swung to block or permit access to said gate tower entrance, said gate tower being formed from a front gate and two gate sidewalls, said front gate including two first slots straddling said gate tower entrance and extending from a bottom edge of said front gate, and said gate sidewalls extending from a first end adjacent said front gate and a second end, each said gate sidewall including a second slot adjacent said first end and extending from a top edge thereof and a third slot adjacent said second end and extending from a bottom edge thereof, said second slots mating with said first slots to connect said gate sidewalls to said front gate, and said third slots mating with reciprocal slots formed in said front wall of said castle to connect said gate tower to said front wall;

a central keep connected to said rear wall and extending into said interior portion of said castle;

a plurality of wall walks suspended from said front, side and rear walls and extending into said interior portion of said castle; and interlocking means for connecting said assembly pieces.

2. A toy castle as claimed in claim 1 wherein said interlocking means consist of reciprocal slots formed in said assembly pieces.

3. A toy castle as claimed in claim 1 wherein said front wall, said side walls, said rear wall, said corner towers, said gate tower and said central keep are formed with a series of merlons and crenels to define a battlement atop said castle.

4. A toy castle as claimed in claim 3 and further comprising removable roofs which cover said corner towers and said gate tower, said roofs having projecting tab portions which extend through said crenels to position said roofs on said towers.

5. A toy castle formed from a plurality of assembly pieces comprising:

a front wall, two side walls and a rear wall;

four corner towers connecting said walls;

a gate tower connected to said front wall and extending away from an interior portion of said castle;

a central keep connected to said rear wall and extending into said interior portion of said castle, said central keep including a center wall and two keep sidewalls, said center wall including two spaced first slots extending from a bottom edge thereof, and said keep sidewalls extending from a first end adjacent said center wall and a second end, each said keep sidewall including a second slot adjacent said first end and extending from a top edge thereof and a third slot adjacent said second end and extending from a bottom edge thereof, said second slots mating with said first slots to connect said keep sidewalls to said center wall, and said third slots mating with reciprocal slots formed in said rear castle wall to connect said central keep to said rear castle wall;

a plurality of wall walks suspended from said front, side and rear walls and extending into said interior portion of said castle; and interlocking means for connecting said assembly pieces.

6. A toy castle formed from a plurality of assembly pieces comprising:

a front wall, two side walls and a rear wall;

four corner towers connecting said walls;

a gate tower connected to said front wall and extending away from an interior portion of said castle;

a central keep connected to said rear wall and extending into said interior portion of said castle;

a plurality of wall walks suspended from said front, side and rear walls and extending into said interior portion of said castle, one of said wall walks being suspended from said rear castle wall and including a central keep roof hingedly attached thereto, said central keep roof being movable to cover or uncover said central keep.

7. A toy castle formed from a plurality of assembly pieces comprising:

a front wall, two side walls and a rear wall;

four corner towers connecting said walls, each said corner tower being formed from four assembly pieces, two of said pieces having spaced first slots extending from their top edges and two of said pieces having spaced second slots extending from their bottom edges, said first slots mating with said second slots to define a rectangular corner tower, and two of said pieces positioned normal to each other further including middle slots extending from bottom edges thereof which mate with reciprocal slots formed in adjacent castle walls to connect said corner towers to said castle walls;

a gate tower connected to said front wall and extending away from an interior portion of said castle;

a central keep connected to said rear wall and extending into said interior portion of said castle;

a plurality of wall walks suspended from said front, side and rear walls and extending into said interior portion of said castle; and interlocking means for connecting said assembly pieces.

8. A toy castle formed from a plurality of assembly pieces comprising:

a front wall, two side walls and a rear wall;

four corner towers connecting said walls;

a gate tower connected to said front wall and extending away from an interior portion of said castle;

a central keep connected to said rear wall and extending into said interior portion of said castle;

a plurality of wall walks suspended from said front, side and rear walls and extending into said interior portion of said castle, said wall walks including two front wall walks hung inside said front castle wall and straddling said gate tower, two side wall walks hung inside said side castle walls, and a rear wall walk hung inside said rear castle wall;

a plurality of wall walk supports attached to top edges of said front, side and rear castle walls, each said wall walk support including a hanging portion attached to a castle wall, and a ledge extending away from said hanging portion towards said interior portion of said castle, said wall walks being placed upon said ledges; and interlocking means for connecting said assembly pieces.

9. A toy castle as claimed in claim 8 wherein said side wall walks interconnect with said rear wall walk and said front wall walks to define one continuous wall walk.

10. A toy castle formed from interlocking a plurality of assembly pieces, said pieces including at least four castle walls connected to define a rectangular enclosure, and a plurality of wall walks hung about an inside perimeter of said walls, said wall walks being supported by wall walk supports having hanging portions including slots extending from bottom edges thereof, said slots mating with reciprocal slots formed in top edges of said castle walls to interlock said wall walk supports with said castle wall, said wall walk supports further including ledges extending away from said hanging portions, said wall walks resting upon said ledges, said castle further including a central keep attached to a rear castle wall and extending into said enclosure, and a rear wall walk hung from said rear castle wall, said rear wall walk including a central keep roof hinged, attached thereto which is movable to cover and uncover said central keep.

* * * * *